United States Patent [19]

Nice

[11] 4,284,220

[45] Aug. 18, 1981

[54] BELT-CARRIED NOTEBOOK AND HOLSTER

[76] Inventor: Gerald W. Nice, P.O. Box 57, Annabella, Utah 84711

[21] Appl. No.: 958,128

[22] Filed: Nov. 6, 1978

[51] Int. Cl.[3] ..... A45F 5/00

[52] U.S. Cl. ..... 224/242; 24/2; 24/204; 224/253; 224/914; 281/1

[58] Field of Search ..... 224/191, 192, 224, 226, 224/253, 904, 197, 914; 150/52 B, 42; 24/2, 204; 2/DIG. 6; 281/29, 15 R, 45, 1; 248/28

[56] References Cited

U.S. PATENT DOCUMENTS

| | | | |
|---|---|---|---|
| 395,155 | 12/1888 | Lipman | 24/2 |
| 601,725 | 4/1898 | Zeugschmidt | 224/197 |
| 967,487 | 8/1910 | Baker | 224/197 X |
| 3,215,322 | 11/1965 | Boyer et al. | 150/52 R X |
| 3,307,754 | 3/1967 | Anketell | 224/904 |
| 3,813,017 | 5/1974 | Pimsleur | 224/240 |
| 4,129,212 | 12/1978 | Hopkins | 281/15 R X |
| 4,157,875 | 6/1979 | Smith et al. | 281/15 A X |
| 4,166,557 | 9/1979 | Conley | 224/253 |

FOREIGN PATENT DOCUMENTS

| | | | |
|---|---|---|---|
| 888838 | 6/1953 | Fed. Rep. of Germany | 281/15 B |
| 1233538 | 10/1960 | France | 150/42 |

*Primary Examiner*—Robert J. Spar
*Assistant Examiner*—Jerold M. Forsberg
*Attorney, Agent, or Firm*—Mallinckrodt & Mallinckrodt

[57] ABSTRACT

A notebook holder having stiff front and back cover members hinged together along corresponding edges thereof, so the front cover member may be swung away from the back cover member for notebook access and swung back for notebook protection, is provided along the inside margins of the free ends of such cover members with cooperative, intergripping strips of fabric of cocklebur type, such as the proprietary material "Velcro", so as to intergrip upon the pressing of the cover members closed by the use of only one hand and so as to maintain such holder in compact condition for easily and quickly slipping into a receiving holster by use of only the one hand. The holster has smooth interior walls to insure free entry for the notebook holder and is preferably adapted for securement to a waist belt in company with a ring retainer for a policeman's club. The notebook holder preferably carries essential data for peace officers, such as the usual Miranda warning, in readable condition on the inside face of the front cover member.

1 Claim, 4 Drawing Figures

BELT-CARRIED NOTEBOOK AND HOLSTER

BACKGROUND OF THE INVENTION

1. Field:

The invention is in the field of notebook holders and is particularly concerned with providing a holstered holder for a policeman's, sheriff's, or other peace officer's notebook in which he records information, often while keeping a suspect covered by a gun held in one hand at the same time the notebook is being manipulated with the other hand.

2. State of the Art:

Up to the present time, peace officers have haphazardly carried notebooks in which they record information on crimes or other incidents they are investigating. Notebooks used have been of various types. Notebook holders have been available for protectively receiving note pad inserts. In some instances, such holders have front and back covers hinged together along corresponding edges thereof and strap fasteners at opposite, free ends of such covers for latching the covers closed about the respective pad inserts.

SUMMARY OF THE INVENTION

In order to enable a peace officer to effectively manipulate a notebook with one hand while using the other to hold a suspect or to cover him with a firearm and to otherwise keep the notebook readily available for use, the present invention provides a holstered notebook holder adapted to receive a pad insert and to itself be closed and held closed in a manner enabling quick and easy insertion in and removal from a belt-carried holster.

For this purpose, a notebook holder having stiff cover members hinged together along corresponding edges, so the notebook holder can be opened and closed by swinging one cover member away from the other, is provided with cooperative, intergripping strips of fabric material of cocklebur type, such as the commercially available material "Velcro", substantially continuously and approximately coextensively along interior margins of their free ends which are thickened to the thickness of a notebook to be received by the holder. When the one cover member that is swung open relative to the other is returned to its notebook protective position following the reading of data carried on the inside face of the front cover and the entry of information in the notebook, a slight pressure by the fingers of the hand holding the notebook holder (exerted at the free cover ends provided with the intergripping fabric strips) will latch the cover members closed and permit quick and easy re-insertion of notebook and holder in the receiving, belt-carried holster by the use of only the one hand involved in manipulating such notebook and holder.

THE DRAWING

In the accompanying drawing, which illustrates an embodiment of the invention presently contemplated as the best mode of carrying out the invention in actual practice:

FIG. 1 is a pictorial view showing the front and one side of a belt-carried, holstered notebook holder in accordance with the invention, the belt being shown only fragmentarily;

FIG. 2, a similar view showing the rear;

FIG. 3, a vertical section taken on the line 3—3 of FIG. 2; and

FIG. 4, a pictorial view of the notebook holder as withdrawn from the holster and opened for use of the contained notebook pad. Thickening means is provided between such interior margins to accommodate the thickness of the notebook pad 15 to be received by the holder. For example, thickening strips 16*a* and 17*a* may be provided as backing for the respective strips of "Velcro" material.

DETAILED DESCRIPTION OF THE ILLUSTRATED EMBODIMENT

Figure 1:
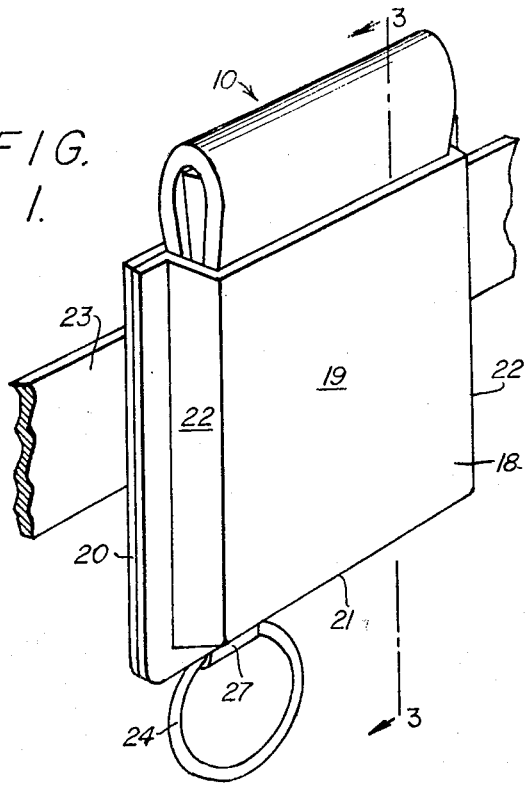
Figure 2:
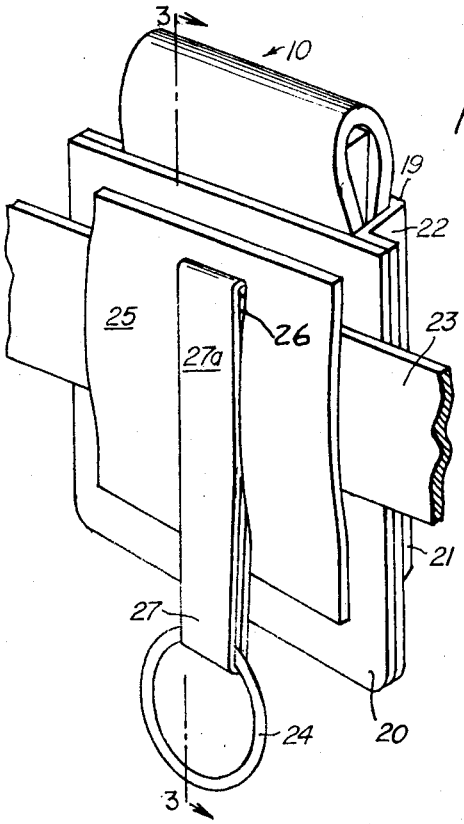

In the form illustrated, the notebook holder 10 is preferably made of either real or simulated stiff leather and has a front cover member 11, a back cover member 12, and a hinge member 13 integral with both front and back cover members at one end thereof. Back cover member 12 is provided with a pocket 14, FIG. 3, for receiving a stiff insert sheet 15*a* at the back of a usual type of spiral-bound pad notebook 15, thereby effectively but removably retaining such notebook within protective holder 10.

Hinge member 13 integrally joins the upper ends of front and back cover members, so that front cover member 11 can be swung upwardly to open the holder and expose notebook pad 15 for use.

At the free lower ends of cover members 11 and 12 and along the interior margins thereof are secured in any suitable manner, as by adhesive or stitching (not shown), cooperative, intergripping strips 16 and 17 of fabric of cocklebur type, such as the proprietary material "Velcro".

Figure 3:
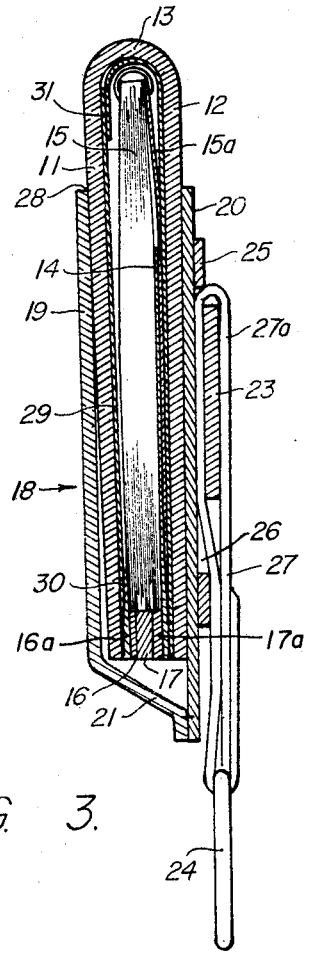
Figure 4:
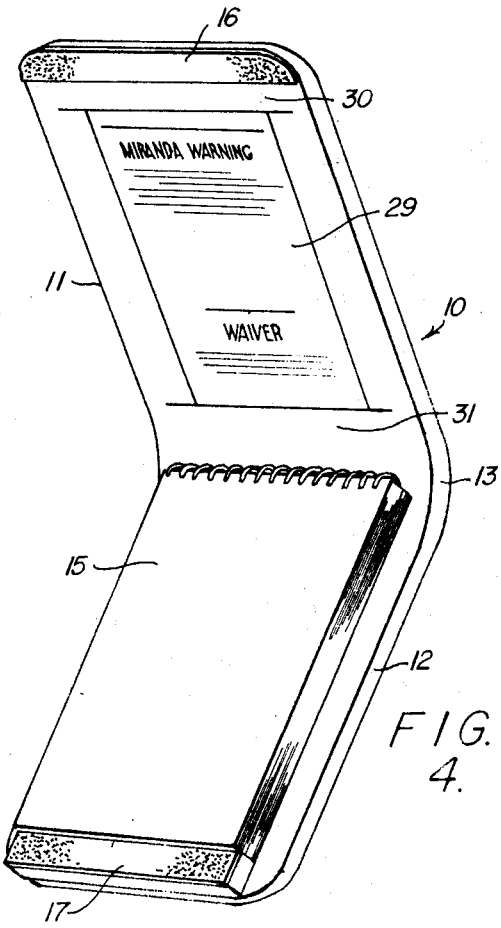

When the cover members 11 and 12 are closed about notebook pad 15, as shown in FIG. 3, the free ends of such cover members are held tightly together along their widths, without external encumbrances. Moreover, tight intergripping is achieved by only slight pressure, which may be easily exerted by the fingers of one hand. Opening of notebook holder 10 is also easily accomplished by the fingers of one hand. Thus, the notebook holder of the invention is ideal for carrying in a beltcarried holster for use by policemen and other peace officers, who are often called upon to manipulate a notebook with one hand while covering a suspect with a firearm.

As illustrated, a holster 18 is also preferably fabricated from real or simulated leather to have stiff, shape-retaining front, back, bottom, and side walls 19, 20, 21, and 22, respectively, with smooth interior faces so as to readily accept notebook holder 10 as an insert. Holster 18 is adapted to be carried by a waist belt 23 along with a billy club holding ring 24. For this purpose, a belt-receiving panel 25 is secured face-to-face to and against the outside face of holster rear wall 20 along its upper and lower margins, leaving an intermediate portion free for the threading of belt 23 therethrough. Intermediate its width, panel 25 is provided with a vertical slot 26 dimensioned to receive closed loop member 27*a* at the upper end of retaining strap 27 for ring 24. By inserting loop member 27*a* in a slot 26 and threading belt 23 therethrough as it passes through the passage formed intermediate the height of panel 25, retaining strap 27 and ring 24 held thereby are secured, along with holster 18, to waist belt 23.

In use, a peace officer need merely extract notebook holder 10 from holster 18 when appropriate, push the front cover member upwardly against the gripping action of fabric strips 16, 17, and enter what information he must in notebook pad 15. This is easily done with only one hand. After entry of the information, the cover members are pressed close and the notebook holder re-inserted, lower end first, in the open mouth 28 of holster 18. Because of the ease with which fabric strips 16 and 17 intergrip and because of the neatly held-together lower ends of notebook holder cover members 11 and 12, without external encumbrances, this can be accomplished easily and quickly also with only one hand.

It should be noted that the notebook-holder-receiving pocket of holster 18 is of sufficiently less depth than the length of notebook holder 10 to provide for protrusion of the hinged upper end 13 of such notebook holder entirely above the holster as a readily graspable portion providing immediate withdrawable accessibility for the user.

It is preferred that the inside face of front cover member 11 carry essential data for peace officers, such as the usual Miranda warning, in easily readable form. To this end, in the illustrated embodiment a printed card 29 is held by mutually spaced leather bands 30 and 31 stitched to front cover member 11 at its inside face.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A holstered notebook holder comprising a notebook holder adapted to receive a notebook pad, said holder having stiff cover members hinged together along one set of corresponding end edges and free along the other edges to permit opening and closing of one cover member relative to the other; cooperative, substantially continuous strips of intergripping fabric of a cocklebur type secured along and approximately coextensively with the inside margins of corresponding free end edges of said cover members that are opposite said hinged end edges, for retaining without external encumbrances said cover members closed about a received notebook pad; and a belt-carried holster open at its upper end and having stiff walls with smooth inside wall faces for receiving said notebook holder, said inside wall faces defining a said notebook-holder-receiver pocket of sufficiently less depth than the length of the notebook holder to provide for protrusion of the hinged end of the latter entirely above the holster as a readily graspable portion of said notebook holder providing immediate withdrawable accessibility for the user, wherein the holster includes a rear panel member secured to the exterior face of the holster back wall so as to provide a passage horizontally for receiving a waist belt, said panel member having a vertical slot intermediate its width dimensioned to receive a closed loop member of a ring-retaining strap, a club-holding ring, and a retaining strap for said ring, said strap having a closed loop member adapted to be received by said vertical slot and to have said waist belt passed therethrough to hold said club-holding ring adjacent to said holster.

* * * * *